US009989922B2

(12) United States Patent
Zaugg et al.

(10) Patent No.: US 9,989,922 B2
(45) Date of Patent: Jun. 5, 2018

(54) ADJUSTABLE AUXILIARY TEMPERATURE COMPENSATION SYSTEM

(71) Applicant: Montres Breguet S.A., L'Abbaye (CH)

(72) Inventors: Alain Zaugg, Le Sentier (CH); Davide Sarchi, Zurich (CH)

(73) Assignee: Montres Breguet S.A., L'Abbaye (CH)

( * ) Notice: Subject to any disclaimer, the term of this patent is extended or adjusted under 35 U.S.C. 154(b) by 0 days. days.

(21) Appl. No.: 15/422,671

(22) Filed: Feb. 2, 2017

(65) Prior Publication Data

US 2017/0255164 A1 Sep. 7, 2017

(30) Foreign Application Priority Data

Mar. 7, 2016 (EP) ..... 16158888

(51) Int. Cl.
*G04B 17/22* (2006.01)
*G04B 17/06* (2006.01)

(52) U.S. Cl.
CPC ..... *G04B 17/222* (2013.01); *G04B 17/063* (2013.01)

(58) Field of Classification Search
CPC .... G04B 17/222; G04B 17/063; G04B 17/22; G04B 17/06; G04B 17/20; G04B 17/227
See application file for complete search history.

(56) References Cited

U.S. PATENT DOCUMENTS 387,567 A 8/1888 Pickert
455,787 A * 7/1891 Bilgram ..... G04B 17/222 368/171
631,103 A 8/1899 Borel
798,993 A * 9/1905 Culman ..... G04B 17/222 368/171
1,982,726 A * 12/1934 Ditisheim ..... G04B 17/222 29/896.31
2,936,572 A * 5/1960 Biemiller ..... G04C 3/06 368/162
D650,301 S * 12/2011 Greubel ..... D10/128
D650,302 S * 12/2011 Greubel ..... D10/128
8,414,184 B2 * 4/2013 Mallet ..... G04B 18/006 368/127
9,188,956 B2 * 11/2015 Nakajima ..... G04B 15/06
2010/0034057 A1 * 2/2010 Levingston ..... G04B 17/222 368/175

FOREIGN PATENT DOCUMENTS

CH 343907 12/1959
FR 701.871 3/1931

OTHER PUBLICATIONS

European Search Report dated Aug. 17, 2016 in European Application 16158888.4, filed on Mar. 7, 2016 (with English Translation of Categories of cited documents).

* cited by examiner

*Primary Examiner* — Sean Kayes
(74) *Attorney, Agent, or Firm* — Oblon, McClelland, Maier & Neustadt, L.L.P.

(57) ABSTRACT

A balance wheel including a rim connected to a hub with at least one arm, wherein the balance wheel includes an adjustable auxiliary temperature compensation system mounted in the space defined by the rim to allow adjustable temperature compensation of the balance wheel.

15 Claims, 6 Drawing Sheets

ADJUSTABLE AUXILIARY TEMPERATURE COMPENSATION SYSTEM

This application claims priority from European Patent application 16158888.4 of Mar. 7, 2016, the entire disclosure of which is hereby incorporated herein by reference.

SCOPE OF THE INVENTION

The invention relates to an adjustable auxiliary temperature compensation system and specifically such a system mounted on a balance wheel for a sprung balance spiral resonator.

BACKGROUND TO THE INVENTION

Document EP 1 422 436, included with reference to this application, explains how to create a compensating balance spring comprising a silicon core coated in silicon dioxide and working alongside a balance wheel with a predetermined inertia to provide temperature compensation for said resonator assembly.

There are many advantages to manufacturing such a compensating balance spring, but they are subject to the disadvantages of any manufacturing process. In other words, the stage in which the balance springs are cut from a silicon plate is subject to a very low level of geometric dispersion, but this is still not negligible in the case of a compensating balance spring where a similar operation needs to be provided for each type of movement.

SUMMARY OF THE INVENTION

The object of this invention is to mitigate some or all of the disadvantages described above by proposing a balance wheel with adjustable temperature compensation to correct manufacturing differences in the components of a sprung balance spiral resonator.

To this end, the invention relates to a balance wheel comprising a rim connected to a hub by at least one arm, characterised in that the balance wheel comprises an adjustable auxiliary temperature compensation system mounted in the space defined by the rim to allow adjustable temperature compensation of the balance wheel.

This thus means that the adjustable auxiliary temperature compensation system can be adapted to a balance wheel for a watch movement that has already been designed and makes it possible to compensate individually for the dispersion inherent to each movement so as to make a sprung balance spiral resonator, for example, even less sensitive to temperature variations than would be the case with a compensating balance spring alone. As a result, the adjustable auxiliary temperature compensation system does not form part of the compensation assembly, but provides a means to refine the basic adjustment.

In accordance with other advantageous embodiments of the invention:

- the adjustable auxiliary temperature compensation system is mounted on said at least one arm, or the hub or rim of the balance wheel;
- the adjustable auxiliary temperature compensation system comprises a fixing device comprising adjustable positioning means between the hub and the rim to adjust the influence of the adjustable auxiliary temperature compensation system;

- the adjustable positioning means comprise a radial recess making it possible to select a position between the hub and the rim;
- the fixing device also comprises adjustable orientation means to adjust the influence of the adjustable auxiliary temperature compensation system;
- the adjustable auxiliary temperature compensation system comprises a bimetallic strip device comprising at least one first strip and at least one second strip, where said at least one first strip and at least one second strip each have different expansion coefficients and are arranged such that they are attached on top of one another to ensure that the curvature of the bimetallic strip device varies as a function of temperature;
- said at least one first strip is based on silicon;
- said at least one second strip is based on metal;
- under ambient temperature and pressure conditions, the bimetallic strip device forms a curved band;
- the bimetallic strip device comprises a block that is integral with the end of one of said at least one first and at least one second strips, making it possible to increase the influence of the adjustable auxiliary temperature compensation system;
- the adjustable auxiliary temperature compensation system also comprises a counterweight to compensate for the weight of the bimetallic strip device;
- the balance wheel comprises a plurality of adjustable auxiliary temperature compensation systems.

Furthermore, the invention relates to a resonator comprising a compensating balance spring where the compensating balance spring is connected to a balance wheel according to one of the previous embodiments.

BRIEF DESCRIPTION OF THE DRAWINGS

Other specific features and advantages will become evident from the description below, provided by way of example and by no means as an exhaustive list, with reference to the attached drawings, in which.

DETAILED DESCRIPTION OF PREFERRED EMBODIMENTS

Figure 1:
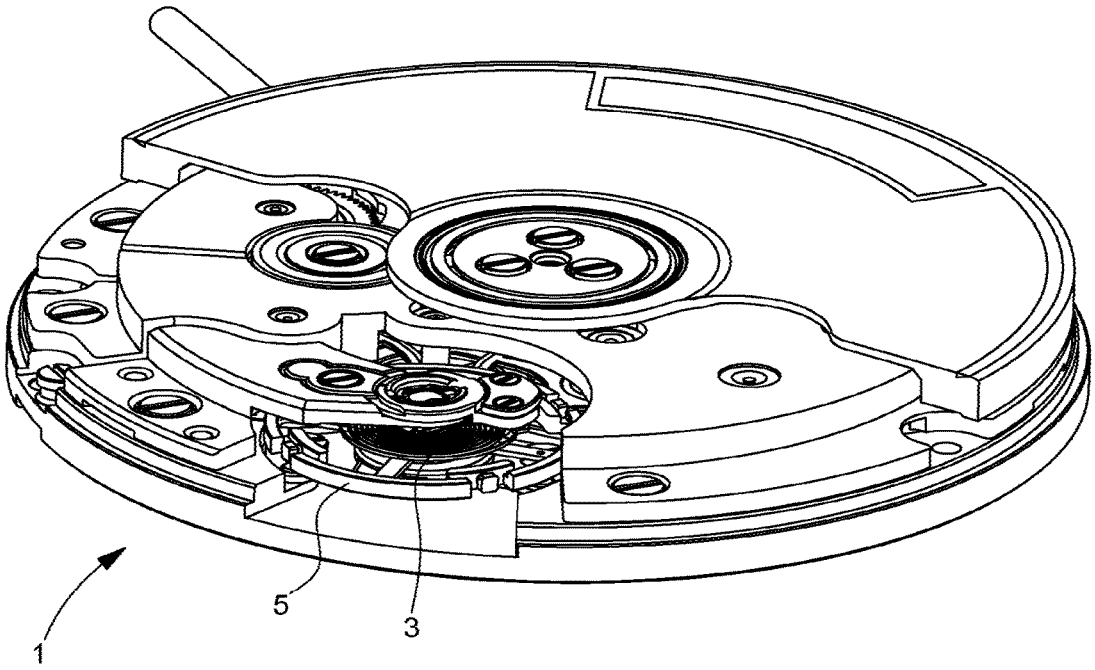
FIG. 1 is a partial representation of a watch movement according to the invention.

As shown in FIG. 1, a resonator 1 comprising a compensating balance spring 3 of the silicon dioxide-coated silicon type and working alongside a balance wheel 5 with predetermined inertia provides unprecedented temperature compensation in the mechanical watchmaking field.

However, manufacturing variables and the fact that the compensating balance spring is not necessarily the silicon dioxide-coated silicon type have led the applicant to seek adjustment solutions. It thus became clear that there was a need for an adjustable auxiliary temperature compensation system to adjust the thermal coefficient of a resonator over a range of $\pm 0.5\ s \cdot j^{-1}.^{\circ -1}$ and that this should be able to be adapted to existing watch movements.

The invention thus proposes modifying a standard balance wheel comprising an uncut rim connected to the hub by means of at least one arm. According to the invention, the balance wheel advantageously comprises an adjustable auxiliary temperature compensation system mounted in the space defined by the uncut rim, or very close to the rim, to allow adjustable temperature compensation of the balance wheel.

This thus means that the adjustable auxiliary temperature compensation system makes it possible to adjust the thermal coefficient of each movement individually so as to make a sprung balance spiral resonator even less sensitive to temperature variations than would be the case with a compensating balance spring alone. As a result, the adjustable auxiliary temperature compensation system does not form part of the compensation assembly, but provides a means to refine the basic adjustment.

Figure 2:
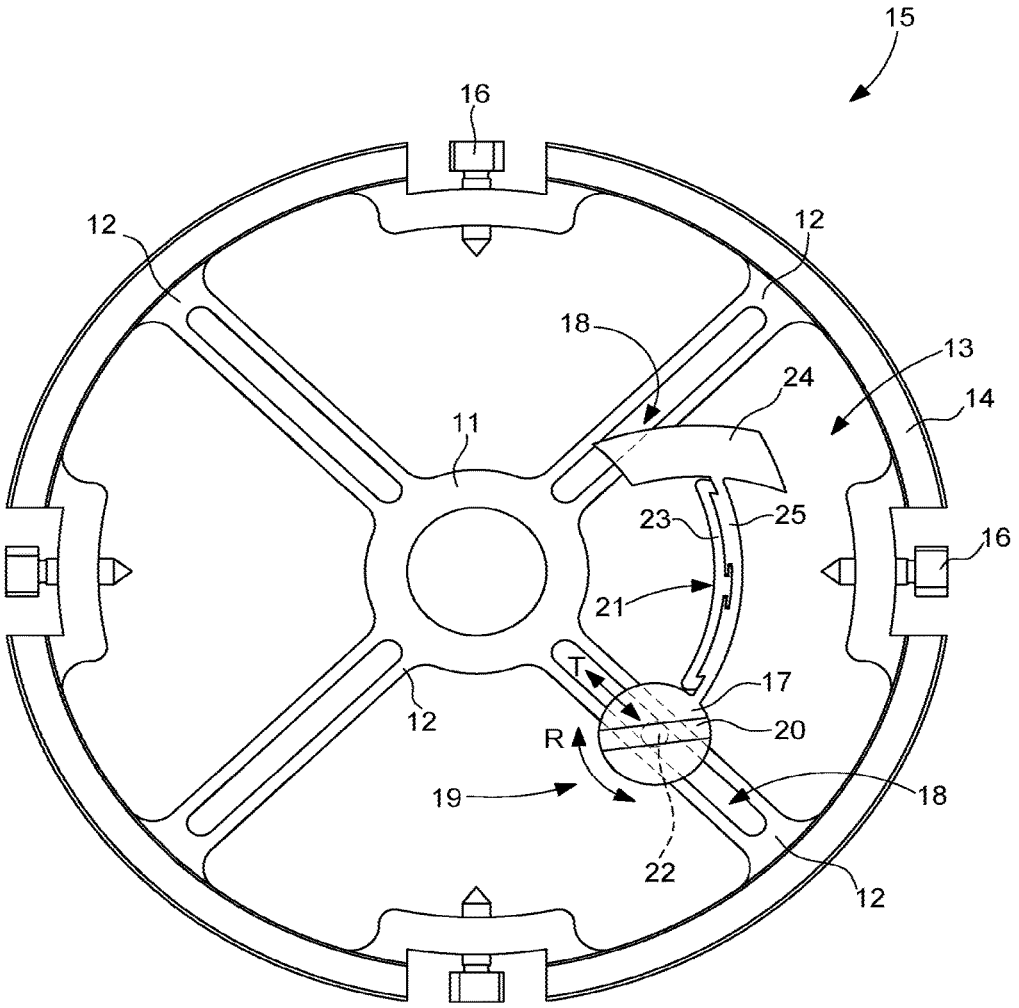
FIGS. 2 to 4 illustrate three embodiments of adjustable auxiliary temperature compensation systems according to the invention.

According to a first embodiment as illustrated in FIG. 2, a balance wheel 15 is shown comprising a rim 14 equipped with adjustment screws 16 and connected to a hub 11 by means of four arms 12. The balance wheel 15 advantageously comprises an adjustable auxiliary temperature compensation system 13 mounted in the space defined by the rim 14, in other words as defined by the internal diameter of the rim 14, or very close to the rim, making it possible to adjust the temperature compensation of the balance wheel 15 in an equivalent volume/in equivalent dimensions.

It is clear that the object is to make it possible to adjust the variation in inertia of the balance wheel 15 in a predetermined manner as a function of temperature variations so as to correct manufacturing differences in the components of a sprung balance spiral resonator 1.

In the first embodiment illustrated in FIG. 2, the adjustable auxiliary temperature compensation system 13 is mounted on one of the arms 12 of the balance wheel 15.

To this end, the adjustable auxiliary temperature compensation system 13 comprises a fixing device 19 comprising adjustable positioning means between the hub 11 and the rim 14 to adjust the influence of the adjustable auxiliary temperature compensation system 13. In the example shown in FIG. 2, the adjustable positioning means comprise a radial recess 18 making it possible to select a position along the radius of the balance wheel 15 with the help of a translational movement T between the hub 11 and the rim 14.

Furthermore, the fixing device 19 also comprises adjustable orientation means to further optimise the way in which the influence of the adjustable auxiliary temperature compensation system 13 is adjusted. In the example in FIG. 2, the adjustable orientation means comprise a pivot 22 mounted in the radial recess 18 enabling the selection of an angle with respect to the arm 12 of the balance wheel 15 by a rotation R of the base 17 of the adjustable auxiliary temperature compensation system 13, for example, by means of the notch 20.

According to the first embodiment illustrated in FIG. 2, the adjustable auxiliary temperature compensation system 13 comprises a bimetallic strip device 21 that forms an integral part of the base 17 and comprises at least one first strip 23 and at least one second strip 25. Said at least one first and at least one second strips 23, 25 each have different expansion coefficients and are arranged such that they are attached on top of one another to ensure that the curvature of the bimetallic strip device 21 varies as a function of temperature.

In addition, the bimetallic strip device 21 comprises a block 24 that is integral with the end of one of said at least one first and at least one second strips 23, 25, making it possible to increase the influence of the adjustable auxiliary temperature compensation system 13.

It is thus clear that by adjusting translational movement T and rotation R of the adjustable auxiliary temperature compensation system 13 in the radial recess 18 in an arm, it is possible to select a predetermined adjustment of the inertia of the balance wheel 15 as a function of temperature variations.

Of course, this invention is not limited to the illustrated example, but has various alternatives and modifications that will be clear to persons skilled in the art. In particular, the balance wheel 15 may comprise a plurality of adjustable auxiliary temperature compensation systems 13 and/or a counterweight may be used for each adjustable auxiliary temperature compensation system 13 as explained for the second embodiment. The balance wheel may also have a different geometry, such as, for example, fewer or more arms, a cut rim or a rim formed from a plurality of curved lobes. Finally, each adjustable auxiliary temperature compensation system 13 could be adapted with respect to its materials or the geometry used for the bimetallic strip device 21 and/or block 24 and/or fixing device 19 according to the required range of adjustment for the thermal coefficient.

Figure 3:
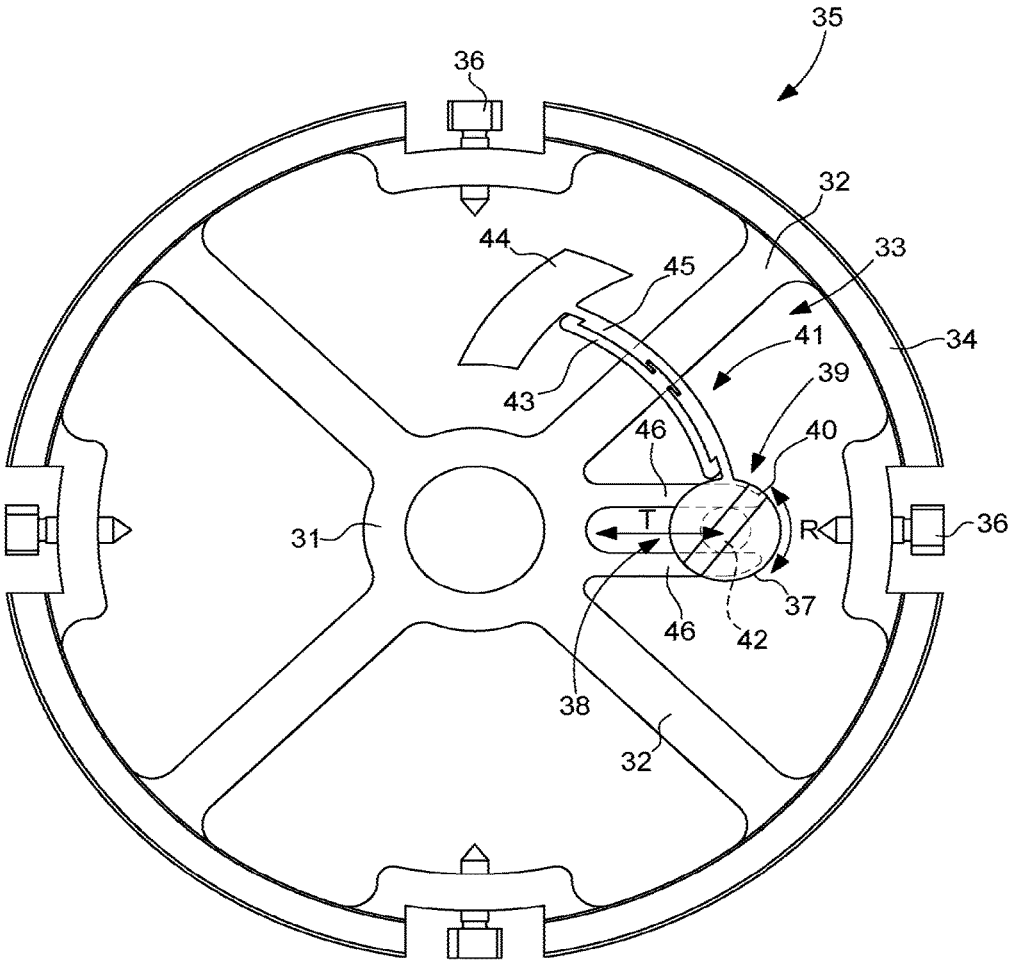

According to a second embodiment as illustrated in FIG. 3, a balance wheel 35 is shown comprising a rim 34 equipped with adjustment screws 36 and connected to a hub 31 by means of four arms 32. According to the invention, the balance wheel 35 advantageously comprises an adjustable auxiliary temperature compensation system 33 mounted in the space defined by the rim 34, in other words the volume defined by the internal diameter of the rim 34, making it possible to adjust temperature compensation of the balance wheel 35.

It is clear that the object is to make it possible to adjust the variation in inertia of the balance wheel 35 in a predetermined manner as a function of temperature variations so as to correct manufacturing differences in the components of a sprung balance spiral resonator 1.

In the second embodiment illustrated in FIG. 3, the adjustable auxiliary temperature compensation system 33 is mounted on the hub 31 of the balance wheel 35 using two feet 46.

To this end, the adjustable auxiliary temperature compensation system 33 comprises a fixing device 39 comprising adjustable positioning means between the hub 31 and the rim 34 to adjust the influence of the adjustable auxiliary temperature compensation system 33. In the example shown in FIG. 3, the adjustable positioning means comprise a radial recess 38 between the two feet 46, making it possible to select a position along the radius of the balance wheel 35 by a translational movement T between the hub 31 and the rim 34.

Furthermore, the fixing device 39 also comprises adjustable orientation means to further optimise the way in which the influence of the adjustable auxiliary temperature compensation system 33 is adjusted. In the example in FIG. 3, the adjustable orientation means comprise a pivot 42 mounted in the radial recess 38 between the feet 46 making it possible to select an angle with respect to the feet 46 by a rotation R of the base 37 of the adjustable auxiliary temperature compensation system 33, for example, by means of the notch 40.

According to the second embodiment illustrated in FIG. 3, the adjustable auxiliary temperature compensation system 33 comprises a bimetallic strip device 41 that forms an integral part of the base 37 and comprises at least one first strip 43 and at least one second strip 45. Said at least one first and at least one second strips 43, 45 each have different expansion coefficients and are arranged such that they are attached on top of one another to ensure that the curvature of the bimetallic strip device 41 varies as a function of temperature.

In addition, the bimetallic strip device 41 comprises a block 44 that is integral with the end of one of said at least one first and at least one second strips 43, 45, making it possible to increase the influence of the adjustable auxiliary temperature compensation system 33.

It is thus clear that by adjusting translational movement T and rotation R of the adjustable auxiliary temperature compensation system 33 in the radial recess 38 of the feet 46, it is possible to select a predetermined adjustment of the inertia of the balance wheel 35 as a function of temperature variations.

Of course, this invention is not limited to the illustrated example, but has various alternatives and modifications that will be clear to persons skilled in the art. In particular, the balance wheel may also have a different geometry, such as, for example, fewer or more arms, a cut rim or a rim formed from a plurality of curved lobes. Furthermore, each adjustable auxiliary temperature compensation system 33 could be adapted with respect to its materials or the geometry used for the bimetallic strip device 41 and/or block 44 and/or fixing device 39 according to the required range of adjustment for the thermal coefficient.

Figure 5:
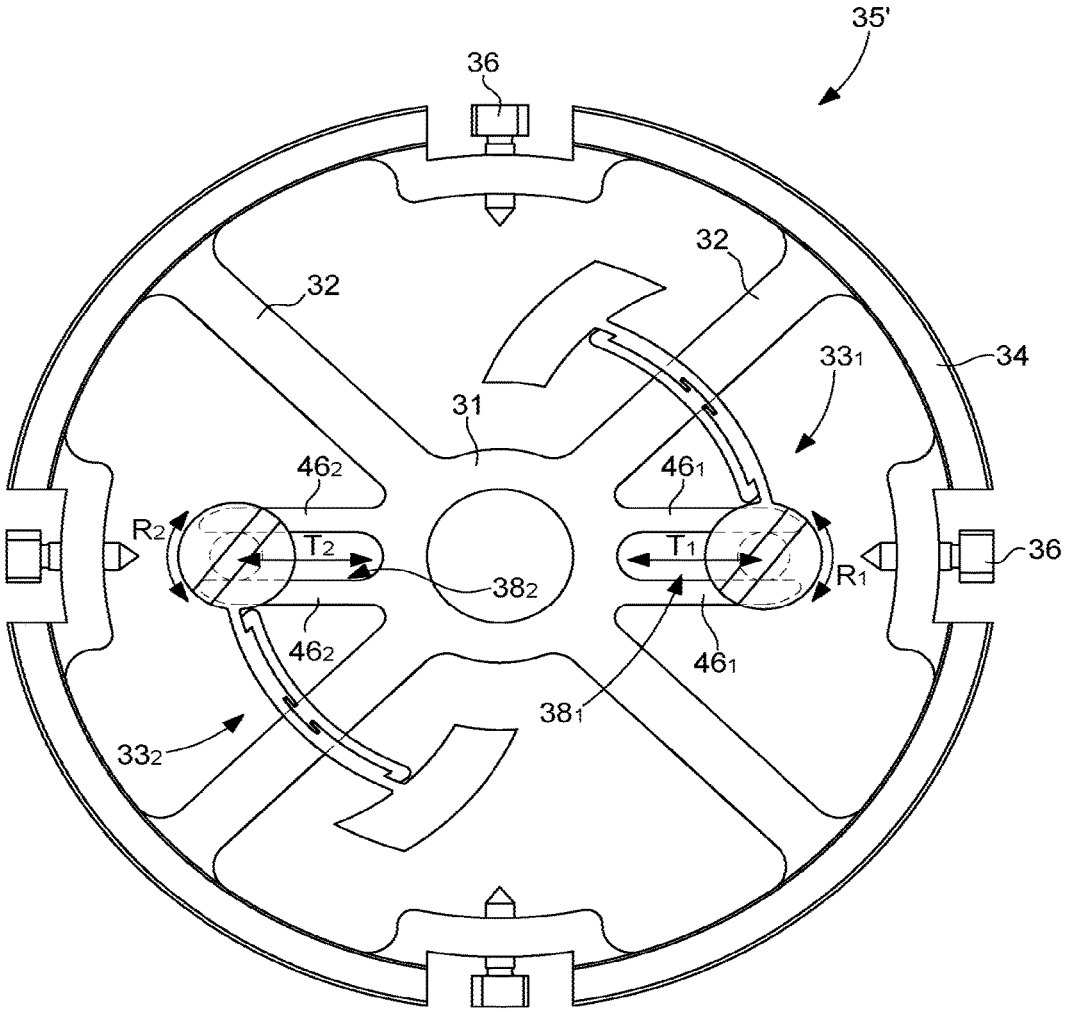
FIGS. 5 to 6 illustrate two alternatives for the second embodiment of an adjustable auxiliary temperature compensation system according to the invention.

Furthermore, according to a first alternative of the second embodiment, the balance wheel 35' may comprise a plurality of adjustable auxiliary temperature compensation systems $\mathbf{33}_1$, $\mathbf{33}_2$ to balance the balance wheel 35'. Thus, as shown in FIG. 5, the balance wheel 35' comprises two adjustable auxiliary temperature compensation systems $\mathbf{33}_1$, $\mathbf{33}_2$ arranged symmetrically with respect to the hub 31.

Thus, by adjusting the translational movement $T_1$, $T_2$ and rotation $R_1$, $R_2$ of each adjustable auxiliary temperature compensation system $\mathbf{33}_1$, $\mathbf{33}_2$ in the radial recess $\mathbf{38}_1$, $\mathbf{38}_2$ of the associated feet $\mathbf{46}_1$, $\mathbf{46}_2$, it is possible to select a predetermined adjustment of the inertia of the balance wheel 35' as a function of temperature variations whilst achieving a better balancing result than in the example shown in FIG. 3.

Finally, according to a second alternative of the second embodiment, the balance wheel 35" may also comprise a counterweight $\mathbf{47}_1$, $\mathbf{47}_2$ for each adjustable auxiliary temperature compensation system $\mathbf{33}_1'$, $\mathbf{33}_2'$ so that the centre of mass of each adjustable auxiliary temperature compensation system $\mathbf{33}_1'$, $\mathbf{33}_2'$ is substantially immobile at a given temperature, such as, for example, 23° C., irrespective of the rotation $R_1$, $R_2$.

Figure 6:
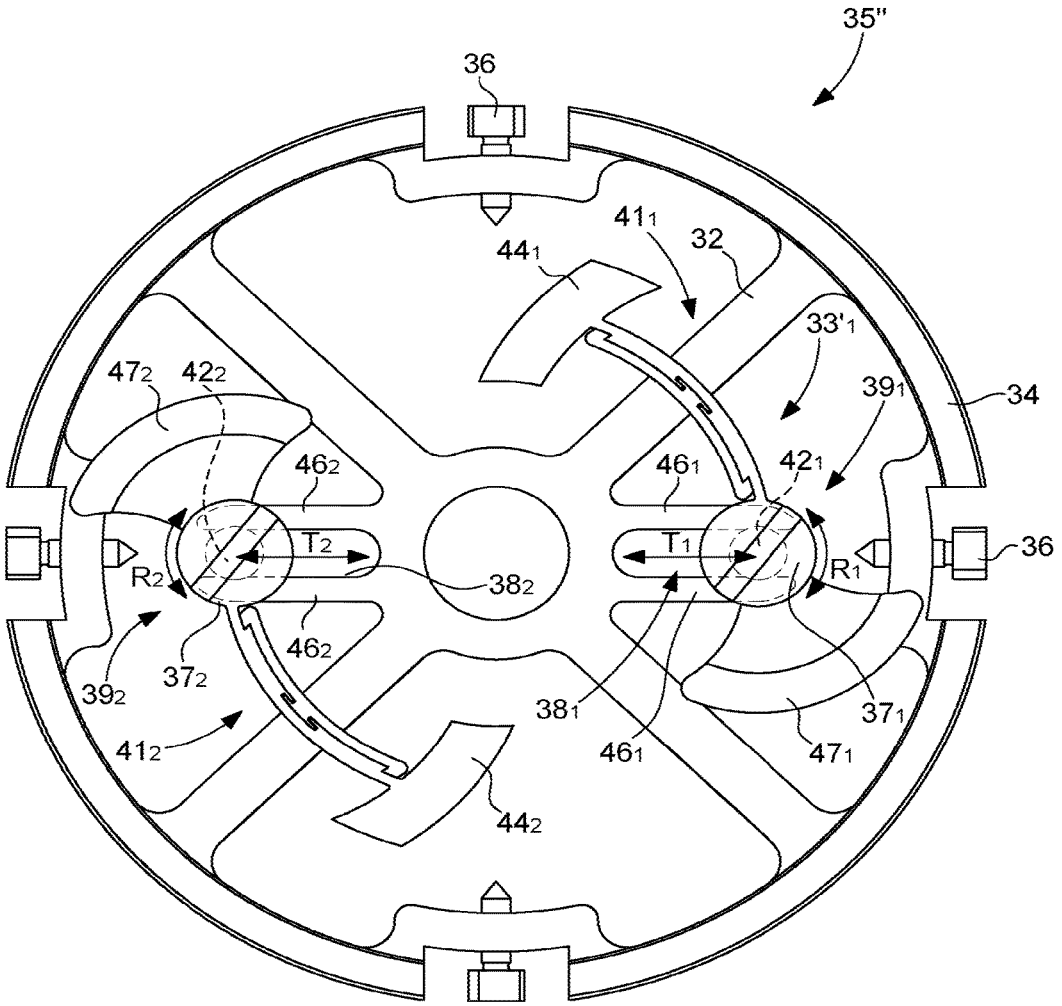

Thus, in the example shown in FIG. 6, which combines the first and second alternatives of the second embodiment, the balance wheel 35" comprises two adjustable auxiliary temperature compensation systems $\mathbf{33}_1'$, $\mathbf{33}_2'$ arranged symmetrically with respect to the hub 31. The adjustable auxiliary temperature compensation systems $\mathbf{33}_1'$, $\mathbf{33}_2'$ are each mounted in the hub 31 of the balance wheel 35" by means of two feet $\mathbf{46}_1$, $\mathbf{46}_2$. As shown in FIG. 6, a counterweight $\mathbf{47}_1$, $\mathbf{47}_2$ forms an integral part of each base $\mathbf{37}_1$, $\mathbf{37}_2$ so as to compensate for the weight of the bimetallic strip assembly $\mathbf{46}_1$, $\mathbf{46}_2$—block $\mathbf{44}_1$, $\mathbf{44}_2$ when each adjustable auxiliary temperature compensation system $\mathbf{33}_1'$, $\mathbf{33}_2'$ performs a rotation $R_1$, $R_2$.

In order to do this, each adjustable auxiliary temperature compensation system $\mathbf{33}_1$, $\mathbf{33}_2$ comprises a fixing device $\mathbf{39}_1$, $\mathbf{39}_2$ comprising adjustable positioning means with a radial recess $\mathbf{38}_1$, $\mathbf{38}_2$ between the two feet $\mathbf{46}_1$, $\mathbf{46}_2$ so that a position can be selected along the balance wheel 35" by means of a translational movement $T_1$, $T_2$ between the hub 31 and the rim 34. It is thus clear that the adjustable auxiliary temperature compensation systems $\mathbf{33}_1$, $\mathbf{33}_2$ have a fixed working radius with respect to the axis of rotation of the balance wheel 35", but this is free, subject to friction, during rotation.

Furthermore, the fixing device $\mathbf{39}_1$, $\mathbf{39}_2$ also comprises adjustable orientation means comprising a pivot $\mathbf{42}_1$, $\mathbf{42}_2$ mounted in the radial recess $\mathbf{38}_1$, $\mathbf{38}_2$ between the feet $\mathbf{46}_1$, $\mathbf{46}_2$ so that it is possible to select an angle with respect to the feet $\mathbf{46}_1$, $\mathbf{46}_2$ by means of a rotation $R_1$, $R_2$ of the base $\mathbf{37}_1$, $\mathbf{37}_2$ of the adjustable auxiliary temperature compensation system $\mathbf{33}_1'$, $\mathbf{33}_2'$.

It is thus clear that by adjusting the translational movement $T_1$, $T_2$ and rotation $R_1$, $R_2$ of each adjustable auxiliary temperature compensation system $\mathbf{33}_1'$, $\mathbf{33}_2'$ in the radial recess $\mathbf{38}_1$, $\mathbf{38}_2$ of the associated feet $\mathbf{46}_1$, $\mathbf{46}_2$, it is possible to select a predetermined adjustment of the inertia of the balance wheel 35" as a function of temperature variations whilst achieving a better balancing result and ensuring that the centre of mass of the adjustable auxiliary temperature compensation systems $\mathbf{33}_1'$, $\mathbf{33}_2'$ remains substantially immobile compared to the example shown in FIG. 3.

Figure 4:
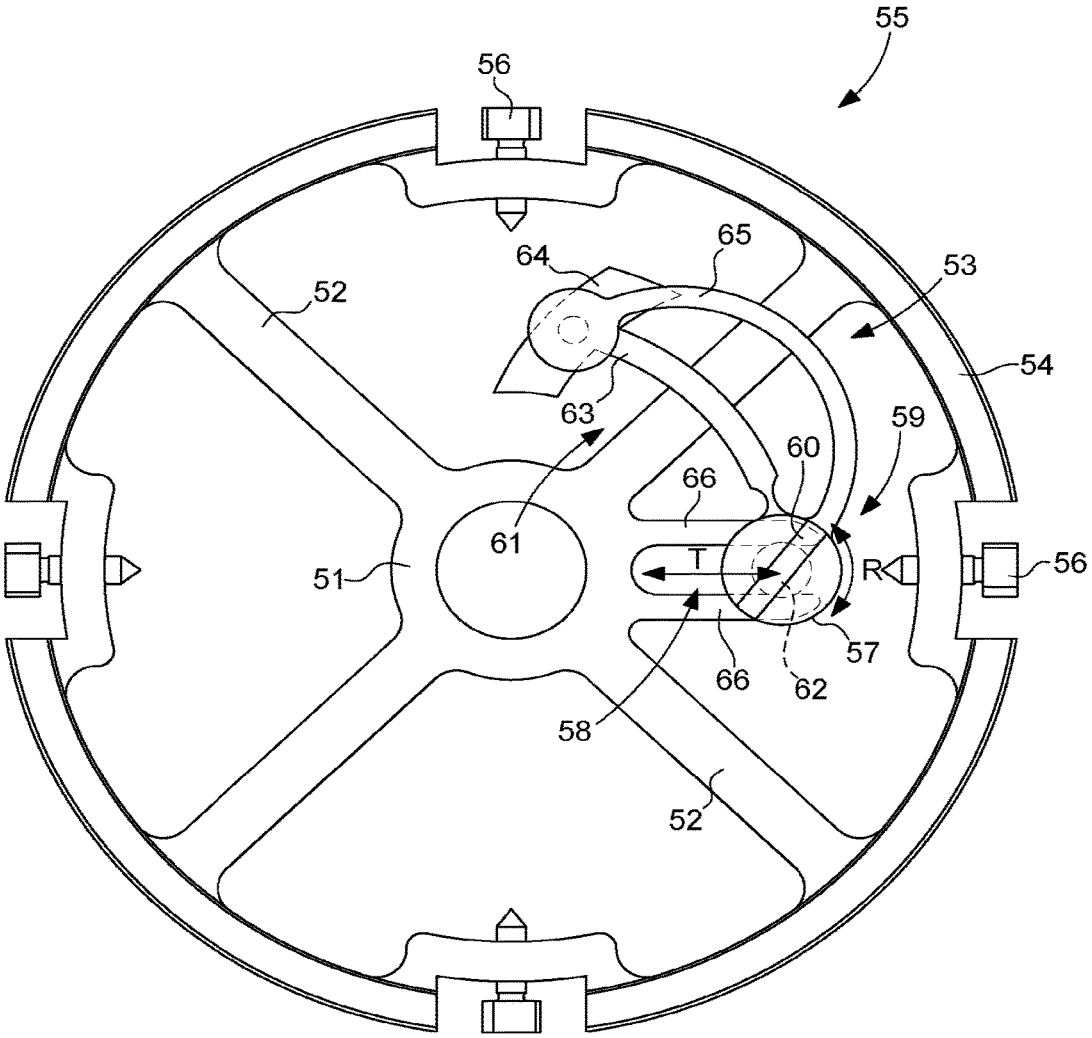

According to a third embodiment as illustrated in FIG. 4, a balance wheel 55 is shown comprising a rim 54 equipped with adjustment screws 56 and connected to a hub 51 by means of four arms 52. According to the invention, the balance wheel 55 advantageously comprises an adjustable auxiliary temperature compensation system 53 mounted in the space defined by the rim 54, in other words the volume defined by the internal diameter of the rim 54, making it possible to adjust the temperature compensation of the balance wheel 55.

It is clear that the object is to make it possible to adjust the variation in inertia of the balance wheel 55 in a predetermined manner as a function of temperature variations so as to correct manufacturing differences in the components of a sprung balance spiral resonator 1.

In the third embodiment illustrated in FIG. 4, the adjustable auxiliary temperature compensation system 53 is mounted on the hub 51 of the balance wheel 55 using two feet 66.

To this end, the adjustable auxiliary temperature compensation system 53 comprises a fixing device 59 comprising adjustable positioning means between the hub 51 and the rim 54 to adjust the influence of the adjustable auxiliary temperature compensation system 53. In the example shown in FIG. 4, the adjustable positioning means comprise a radial recess 58 between the two feet 66, making it possible to select a position along the radius of the balance wheel 55 by means of a translational movement T between the hub 51 and the rim 54.

Furthermore, the fixing device 59 also comprises adjustable orientation means to further optimise the way in which the influence of the adjustable auxiliary temperature compensation system 53 is adjusted. In the example in FIG. 4, the adjustable orientation means comprise a pivot 62 mounted in the radial recess 58 between the feet 66 making it possible to select an angle with respect to the feet 66 by a rotation R of the base 57 of the adjustable auxiliary temperature compensation system 53, for example, by means of the notch 60.

According to the third embodiment illustrated in FIG. 4, the adjustable auxiliary temperature compensation system 53 comprises a bimetallic strip device 61 that forms an integral part of the base 57 and comprises at least one first strip 63 and at least one second strip 65. Said at least one first and at least one second strips 63, 65 each have different expansion coefficients and are arranged such that they are attached on top of one another to ensure that the curvature of the bimetallic strip device 61 varies as a function of temperature.

In addition, the bimetallic strip device 61 comprises a block 64 that is integral with the end of one of said at least one first and at least one second strips 63, 65, making it possible to increase the influence of the adjustable auxiliary temperature compensation system 53.

It is thus clear that by adjusting translational movement T and rotation R of the adjustable auxiliary temperature compensation system 53 in the radial recess 58 of the feet 66, it is possible to select a predetermined adjustment of the inertia of the balance wheel 55 as a function of temperature variations.

Of course, this invention is not limited to the illustrated example, but has various alternatives and modifications that will be clear to persons skilled in the art. In particular, the balance wheel 55 may comprise a plurality of adjustable auxiliary temperature compensation systems 53 and/or a counterweight may be used for each adjustable auxiliary temperature compensation system 53 as explained above for the second embodiment. The balance wheel may also have a different geometry, such as, for example, fewer or more arms, a cut rim or a rim formed from a plurality of curved lobes. Finally, each adjustable auxiliary temperature compensation system 53 could be adapted with respect to its materials or the geometry used for the bimetallic strip device 61 and/or block 64 and/or fixing device 59 according to the required range of adjustment for the thermal coefficient.

The bimetallic strip device must be sensitive to temperature variations for each embodiment of the balance wheel. The bimetallic strip device according to the invention preferably comprises at least one first strip based on silicon and at least one second strip based on metal.

Said at least one first strip based on silicon may comprise monocrystalline silicon, doped monocrystalline silicon, polycrystalline silicon, doped polycrystalline silicon, porous silicon, silicon oxide, quartz, silica, silicon nitride or silicon carbide. Of course, when the silicon-based material is in the crystalline phase, any crystalline orientation may be used.

Furthermore, said at least one second strip based on metal may comprise silver and/or magnesium and/or lead and/or thallium and/or nickel and/or copper and/or zinc and/or gold and/or aluminium and/or indium and/or vulcanite.

According to the invention, said at least one first and at least one second strips are arranged such that they are attached to one another to ensure that the curvature of the bimetallic strip device varies as a function of temperature. In effect, the band formed by said at least one first and at least one second strips curves as the temperature increases on the side on which the expansion coefficient is lowest.

In addition, this specifically means that the bimetallic strip device may comprise a plurality of first strips that are arranged such that they can be attached to a single second strip or, alternatively, that a plurality of second strips are arranged such that they can be attached to a single first strip.

In the case of the above embodiments, the required difference in expansion coefficient of the bimetallic strip device is approximately between 10 and 30 $10^{-6}$ $K^{-1}$ and it should also preferably have low sensitivity to magnetic fields. The combination of monocrystalline silicon and nickel/phosphorus alloy is used from preference. Of course, other alloys may be applied by galvanic growth technology, such as gold. It is also conceivable to assemble a silicon-based component on components machined in a more traditional manner such as copper alloys or non-magnetic steels.

In this way, monocrystalline silicon has a linear expansion coefficient $\alpha$ at 25° C. of around 2.5 $10^{-6}$ $K^{-1}$, whereas metals or metal alloys generally have linear expansion coefficients at 25° C. of between substantially 13 and 32 $10^{-6}$ $K^{-1}$. It is thus clear that the difference in expansion coefficient of the bimetallic strip device leads to high temperature sensitivity.

According to the invention, under ambient temperature and pressure conditions (ATPC) corresponding to a temperature of 25° C. and a pressure of 100 kPa, the bimetallic strip device preferentially forms a curved band.

As illustrated in the first and second embodiments above, said at least one first and at least one second strips are attached on top of one another by interlocking. In this way, interlocking means may be formed either by a groove-hook assembly or by notch-rib assemblies.

Of course, said at least one first and at least one second strips could be attached on top of one another by using an adhesive material or by electro-forming as an additional or alternative option.

Of course, this invention is not limited to the illustrated example, but has various alternatives and modifications that will be clear to persons skilled in the art. In particular, a plurality of identical or different bimetallic strip devices 21, 41, $\mathbf{41_1}$, $\mathbf{41_2}$, 61 could be distributed between each base 17, 37, $\mathbf{37_1}$, $\mathbf{37_2}$, 57 and each block 24, 44, $\mathbf{44_1}$, $\mathbf{44_2}$, 64.

In addition, each block 24, 44, $\mathbf{44_1}$, $\mathbf{44_2}$, 64 could alternatively be replaced by a weight fixed to the free end of one of said at least one first and/or at least one second strips in a similar manner to the adjustment screws 16, 36, 56, in other words screwed into said strips. The weight could thus be formed from a third material, which may, for example, be denser than the first two materials.

Finally, as explained above, the adjustable auxiliary temperature compensation system may be mounted on an arm or on the hub of the balance wheel. However, there is nothing to prevent the adjustable auxiliary temperature compensation system alternatively being mounted on the rim of the balance wheel, in other words on the internal or external diameter of the rim of the balance wheel.

What is claimed is:

1. A balance wheel comprising a rim connected to a hub with at least one arm, the balance wheel comprising an adjustable auxiliary temperature compensation system mounted in the space defined by the rim, the adjustable auxiliary temperature compensation system being configured to adjust the temperature compensation of the balance wheel, the temperature compensation system comprising:

a bimetallic strip device comprising at least one first strip and at least one second strip, said at least one first and at least one second strips each having different expansion coefficients and are arranged such that they are attached on top of one another to ensure that the curvature of the bimetallic strip device varies as a function of temperature, the bimetallic strip device extending between a first end and a second end;

a fixing device forming an integral part of the first end of the bimetallic strip device, the fixing device comprising adjustable orientation means configured to change the orientation of the compensation system with respect to said at least one arm of the balance wheel, a block forming an integral part of the second end of the bimetallic strip device.

2. The balance wheel according to claim 1, wherein the adjustable auxiliary temperature compensation system is mounted on said at least one arm of the balance wheel.

3. The balance wheel according to claim 1, wherein the adjustable auxiliary temperature compensation system is mounted on the hub of the balance wheel.

4. The balance wheel according to claim 1, wherein the adjustable auxiliary temperature compensation system is mounted on the rim of the balance wheel.

5. The balance wheel according to claim 1, wherein the fixing device comprises adjustable positioning means between the hub and the rim so as to adjust the influence of the adjustable auxiliary temperature compensation system, the adjustable positioning means being arranged to modify the radial distance between the hub and the first end of the bimetallic strip device.

6. The balance wheel according to claim 5, wherein the adjustable positioning means comprise a radial recess so as to select a position between the hub and the rim.

7. The balance wheel according to claim 1, wherein said at least one first strip is based on silicon.

8. The balance wheel according to claim 1, wherein said at least one second strip is based on metal.

9. The balance wheel according to claim 1, wherein the bimetallic strip device forms a curved band under ambient temperature and pressure conditions.

10. The balance wheel according to claim 1, wherein the block forms an integral part of one of the ends of said at least one first and at least one second strips to increase the influence of the adjustable auxiliary temperature compensation system.

11. The balance wheel according to claim 1, wherein the adjustable auxiliary temperature compensation system also comprises a counterweight to compensate for the weight of the bimetallic strip device.

12. The balance wheel according to claim 1, wherein the balance wheel comprises a plurality of adjustable auxiliary temperature compensation systems.

13. The balance wheel according to claim 1, wherein the block extends in a curve secant to the bimetallic strip device.

14. The balance wheel according to claim 1, wherein the block comprises two projecting parts either side of the bimetallic strip device.

15. A resonator comprising a compensating balance spring, wherein the compensating balance spring is connected to a balance wheel according to claim 1.

* * * * *